US011820124B2

(12) United States Patent
Ernst

(10) Patent No.: US 11,820,124 B2
(45) Date of Patent: Nov. 21, 2023

(54) CONTINUOUS-FORMS COLOR MEASUREMENT SYSTEM

(71) Applicant: Larry M Ernst, Longmont, CO (US)

(72) Inventor: Larry M Ernst, Longmont, CO (US)

(73) Assignee: Ricoh Company, Ltd., Tokyo (JP)

( * ) Notice: Subject to any disclaimer, the term of this patent is extended or adjusted under 35 U.S.C. 154(b) by 156 days.

(21) Appl. No.: 17/405,893

(22) Filed: Aug. 18, 2021

(65) Prior Publication Data

US 2023/0057725 A1 Feb. 23, 2023

(51) Int. Cl.

| | |
|---|---|
| ***B41F 33/00*** | (2006.01) |
| ***B41F 13/02*** | (2006.01) |
| ***B41J 11/057*** | (2006.01) |
| ***B41J 11/13*** | (2006.01) |
| ***B41J 11/00*** | (2006.01) |

(52) U.S. Cl.

CPC ..... *B41F 33/0036* (2013.01); *B41F 13/02* (2013.01); *B41J 11/0095* (2013.01); *B41J 11/057* (2013.01); *B41J 11/13* (2013.01)

(58) Field of Classification Search

CPC ..... B41J 11/13; B41J 11/057; B41J 11/0095; B41F 13/02; B41F 33/0036

See application file for complete search history.

(56) References Cited

U.S. PATENT DOCUMENTS

| | | | | |
|---|---|---|---|---|
| 5,766,280 | A * | 6/1998 | Hallqvist | B65B 41/18 53/399 |
| 6,053,107 | A * | 4/2000 | Hertel | B41F 13/025 101/220 |
| 6,112,658 | A * | 9/2000 | Gunther | B26D 5/007 101/171 |
| 7,398,733 | B2 | 7/2008 | Vries et al. | |
| 9,662,909 | B2 | 5/2017 | Verdugo et al. | |
| 10,506,107 | B2 | 12/2019 | Lachajewski et al. | |
| 10,525,735 | B2 | 1/2020 | Fernando et al. | |
| 2005/0115575 | A1* | 6/2005 | Seymour | A24C 5/3412 131/908 |
| 2009/0260739 | A1* | 10/2009 | Fischer | B41J 3/407 156/290 |
| 2010/0128099 | A1* | 5/2010 | Evans | B41J 2/36 347/171 |

(Continued)

FOREIGN PATENT DOCUMENTS

| | | | |
|---|---|---|---|
| DE | 102012209896 | B4 | 3/2014 |
| JP | 10193575 | A * | 7/1998 |

OTHER PUBLICATIONS

Brian Gamn; In-Line Color Measurement Spectrophotometer Improves Press Control and Customer Satisfaction; Flexo Magzine; Nov. 2016.

*Primary Examiner* — David H Banh
(74) *Attorney, Agent, or Firm* — Duft & Bornsen, PC

(57) ABSTRACT

Systems and methods are provided for measuring a web. One embodiment is a measurement system that includes rollers which receive a web of print media marked with a printed job, a controller which determines that a segment of the web is stationary at the measurement system, an image measurement device that inspects the printed job, and a repositioning mechanism that repositions the segment within the measurement system relative to the image measurement device while portions of the web external to the measurement system remain stationary.

23 Claims, 9 Drawing Sheets

(56) References Cited

U.S. PATENT DOCUMENTS

2010/0243126 A1* 9/2010 Strunk ..... B44C 1/1729
156/64
2010/0243698 A1* 9/2010 Hashimoto ..... B65H 23/1888
226/21
2011/0083789 A1* 4/2011 Nakazono ..... G02F 1/133305
156/64
2011/0131799 A1* 6/2011 Ito ..... H01M 4/0435
72/203
2011/0316909 A1* 12/2011 Yamanobe ..... B41J 11/0015
347/8
2013/0088715 A1* 4/2013 Adam ..... G01J 3/0289
356/400
2013/0155131 A1* 6/2013 Izawa ..... B41J 15/005
347/5
2014/0069286 A1* 3/2014 Haushahn ..... B41J 15/165
101/228
2014/0146163 A1* 5/2014 Woo ..... G01N 21/8901
348/88
2014/0196585 A1* 7/2014 Takahashi ..... A61F 13/15585
83/23
2015/0018186 A1* 1/2015 Nobukuni ..... B26D 5/32
493/29
2016/0036086 A1* 2/2016 Lee ..... B65H 23/1806
242/443
2016/0238861 A1* 8/2016 Yura ..... B32B 38/0004

* cited by examiner

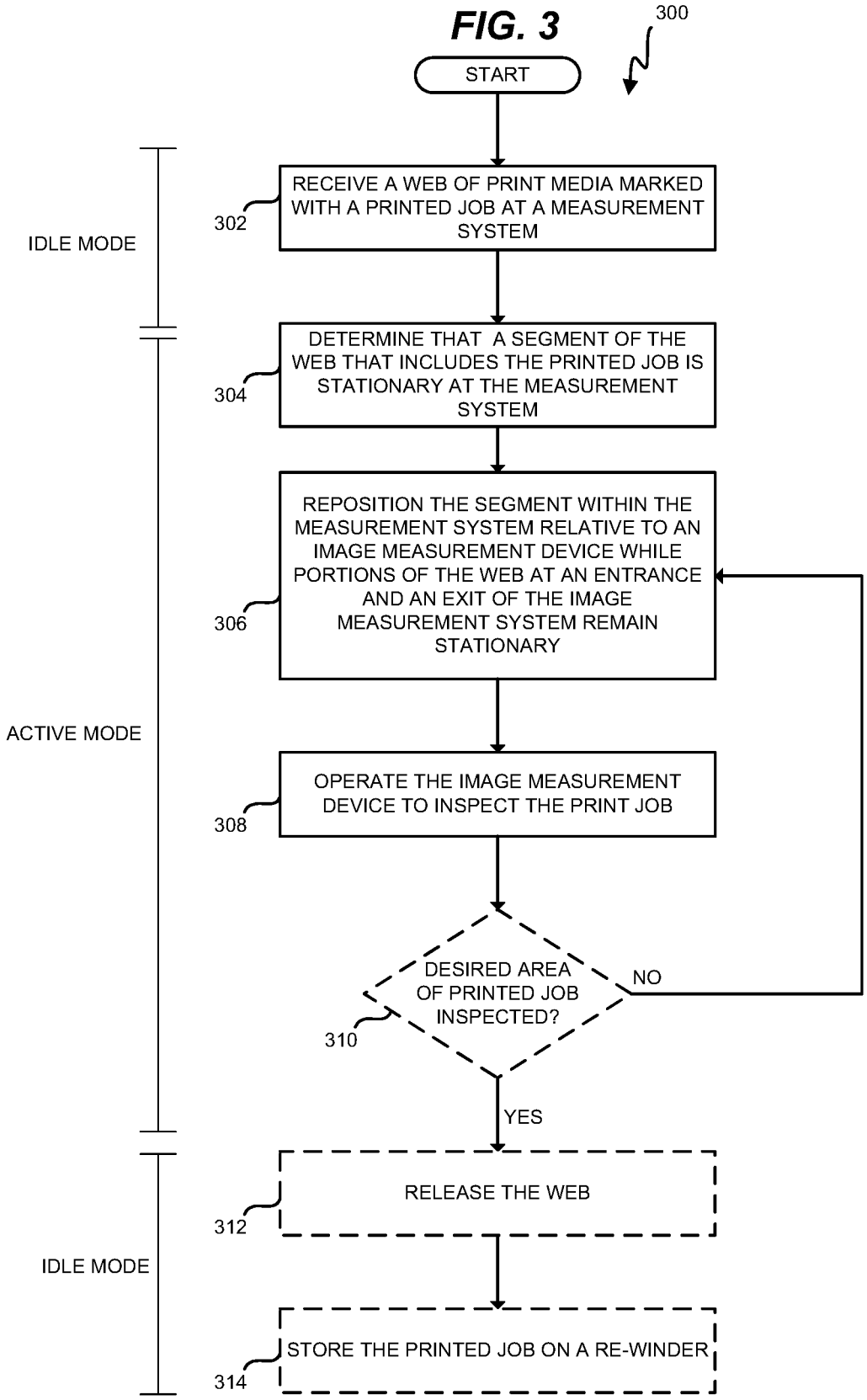
FIG. 3
300
START
IDLE MODE
302
RECEIVE A WEB OF PRINT MEDIA MARKED WITH A PRINTED JOB AT A MEASUREMENT SYSTEM
304
DETERMINE THAT A SEGMENT OF THE WEB THAT INCLUDES THE PRINTED JOB IS STATIONARY AT THE MEASUREMENT SYSTEM
306
REPOSITION THE SEGMENT WITHIN THE MEASUREMENT SYSTEM RELATIVE TO AN IMAGE MEASUREMENT DEVICE WHILE PORTIONS OF THE WEB AT AN ENTRANCE AND AN EXIT OF THE IMAGE MEASUREMENT SYSTEM REMAIN STATIONARY
ACTIVE MODE
308
OPERATE THE IMAGE MEASUREMENT DEVICE TO INSPECT THE PRINT JOB
310
DESIRED AREA OF PRINTED JOB INSPECTED?
NO
YES
IDLE MODE
312
RELEASE THE WEB
314
STORE THE PRINTED JOB ON A RE-WINDER

CONTINUOUS-FORMS COLOR MEASUREMENT SYSTEM

TECHNICAL FIELD

The following disclosure relates to the field of printing, and in particular, to continuous-forms printing.

BACKGROUND

Entities with substantial printing demands typically use a production printer. A production printer is a high-speed printer used for volume printing, such as a continuous-forms printer that prints on a web of print media stored on a large roll. A production printer typically includes a localized print controller that manages the overall operation of the printer, and a marking engine (sometimes referred to as an "imaging engine" or a "print engine"). The marking engine includes one or more arrays of printheads. A printer may be just one of numerous devices on a print line that operate in coordination to prepare a print job.

Upon receiving digital information for a print job, the print controller rasterizes logical pages of the job (e.g., to create bitmaps representing each page of the print job), and the marking engine operates individual printheads to mark the web based on the rasterized logical pages. Thus, the printer marks physical pages based on the digital information for the print job. The physical print media that has been marked based on digital information for a print job is referred to as a "printed job."

To ensure that print quality standards are met for a printed job, unique print jobs consisting of color patches are sent to the printer. These unique print job can be analyzed to confirm that the printer is printing to specification. These unique print jobs can also be analyzed to determine adjustments desired at the printer, for example when paper is changed, ink set is changed, or parts are replaced. The unique print job may consist of a page that includes one or more widthwise rows of test patches. For example, rows of test patches may be disposed at each of multiple locations along the length of the print job. The analysis process for such test patches is highly time-consuming, as a spectrophotometer or other image measurement device is needed to verify that printed colors exactly match desired colors. Printing systems may print incoming jobs at rates of hundreds of linear feet per minute, but measuring devices, especially spectrophotometers, process the printed job at much slower rates (e.g., one or more orders of magnitude slower than the rate of printing) and are particularly expensive. This means that it is not possible to accurately characterize all test patches during printing onto the web. Thus, print shop operators are forced to manually inspecting a set of test patches after the printed job has been cut from the web. Further complicating these matters, colors may change slightly after printing, especially in the first thirty minutes after printing. Hence, it may not be desirable to measure test patches immediately after printing.

Thus, those of ordinary skill in the art continue to seek out new solutions to these issues.

SUMMARY

Embodiments described herein perform on-web measurements of a printed job after printing has concluded and the printed job has been stored internally in a measurement system. The measurement system moves the printed job incrementally past a measurement device after printing in order to measure the printed job, without the printed job exiting the measurement system. As the printed job is moved, portions of the web at an entrance and exit of the measurement system remain stationary. This provides a technical benefit because it allows the measurement system to perform incremental inspection by moving the printed job into the purview of the measurement device, without the need to move the entire web synchronously through all continuous-forms devices on the print line. One embodiment is a measurement system that includes rollers that receive a web of print media marked with a printed job, a controller that determines that a segment of the web is stationary at the measurement system, an image measurement device that inspects the printed job; and a repositioning mechanism that repositions the segment within the measurement system relative to the image measurement device while portions of the web external to the measurement system remain stationary.

A further embodiment is a method that includes receiving a web of print media marked with a printed job at a measurement system, determining that a segment of the web that includes the printed job is stationary at the measurement system, and iteratively repositioning the segment within the measurement system relative to an image measurement device while portions of the web external to the measurement system remain stationary, and operating the image measurement device to inspect the printed job.

A further embodiment is a non-transitory computer readable medium embodying programmed instructions which, when executed by a processor, are operable for performing a method. The method includes receiving a web of print media marked with a printed job at a measurement system, determining that a segment of the web that includes the printed job is stationary at the measurement system, and iteratively repositioning the segment within the measurement system relative to an image measurement device while portions of the web external to the measurement system remain stationary, and operating the image measurement device to inspect the printed job.

Other illustrative embodiments (e.g., methods and computer-readable media relating to the foregoing embodiments) may be described below.

DESCRIPTION OF THE DRAWINGS

Some embodiments of the present invention are now described, by way of example only, and with reference to the accompanying drawings. The same reference number represents the same element or the same type of element on all drawings.

FIG. 3 is a flowchart illustrating a method for operating a measurement system at a printing system in an illustrative embodiment.

DETAILED DESCRIPTION

The figures and the following description illustrate specific illustrative embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
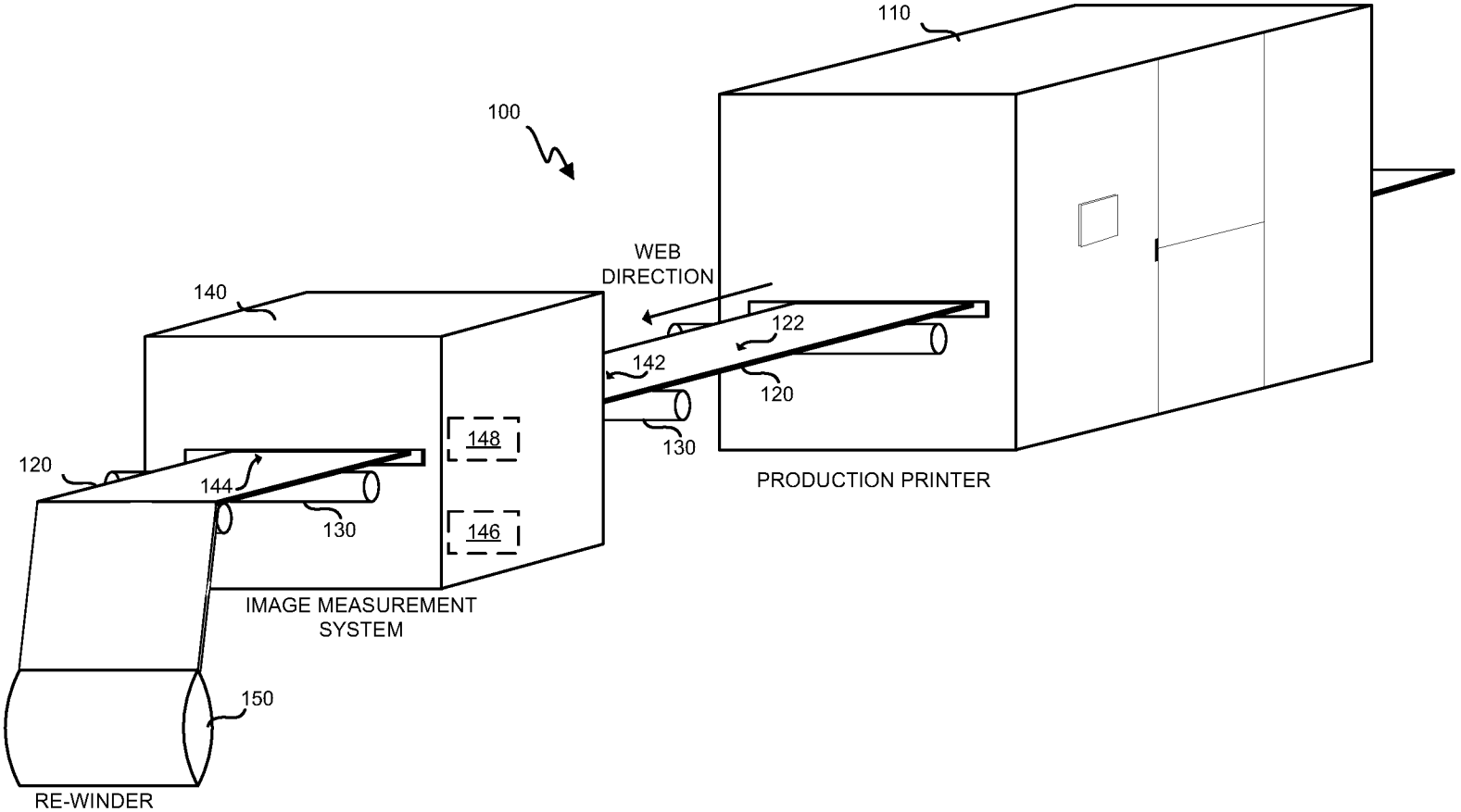
FIG. 1 is a diagram of a printing system in an illustrative embodiment.

FIG. 1 is a diagram of a printing system 100 in an illustrative embodiment. Printing system 100 has been enhanced with a measurement system 140 that is capable of performing on-web measurement of printed jobs that have just been printed. In this embodiment, printing system 100 includes production printer 110, which is operable to mark a web 120 of continuous-forms print media 122 (e.g., paper or any other substrate suitable for printing). As used herein, the word "mark" refers to applying any suitable visible feature onto the web 120 in accordance with programmed instructions. These visible features include those made by any suitable marking fluid (e.g., aqueous inks, oil-based paints, etc.). In one embodiment, production printer 110 comprises an inkjet printer that applies colored inks, such as Cyan (C), Magenta (M), Yellow (Y), and Key (K) black inks. One or more rollers 130 position the web 120 as the web 120 travels through printing system 100. Printing system 100 may further include a dryer (not shown) that is integrated with the production printer 110, or downstream of the production printer 110.

As used herein, a printed job comprises marks applied to print media in accordance with programmed instructions. For example, a printed job may comprise marks applied based on logical pages of a Page Description Language (PDL) print job that have been rasterized. A printed job may comprise multiple pages that will be cut from a web of print media, and may be accompanied by test patches that have been printed by the printer onto the printed job, or onto pages adjacent to the printed jobs. Thus, the test patches may be part of the print job or may be separately printed by the printer. The test patches ensure color (or other) accuracy of the printed job. For example, test patches that indicate the quality of a printed job may be printed before, together with, or after the printed job.

During printing, the web 120 is marked by the production printer 110 and continues in a web direction into measurement system 140. As a part of the printing process, web 120 advances in a web direction into measurement system 140. For example, web 120 may travel at a linear velocity of up to two hundred meters per minute through production printer 110 and into measurement system 140. Measurement system 140 continues to take up portions of the web 120 that have been marked, until printing has stopped for the printed job. Thus, at the end of printing, the entire printed job, or a portion of the entire print job on which test patches have been printed, may be stored within the measurement system 140. After printing has completed and the printed job is held within measurement system 140, measurement system 140 proceeds to inspect the printed job. The inspection process is performed by operating a repositioning mechanism 148 that moves the printed job internally within the measurement system 140, relative to an internal image measurement device. The movement of the printed job during inspection occurs while portions of the web 120 external to the measurement system 140 (e.g., at an entrance 142 and an exit 144 of the measurement system 140) remain stationary. Thus, devices external to the measurement system 140 experience no pulling or tension on the web 120 due to the inspection process.

The inspection process, including control of movement of the printed job inside the measurement system 140, may be managed by the operations of a controller 146 that is either internal to or coupled for communication with the measurement system 140. Controller 146 may be implemented as custom circuitry, as a hardware processor executing programmed instructions, etc.

The architecture of the measurement system 140 provides for numerous technical benefits. First, it allows for the measurement system 140 to measure the printed job at a different rate of speed than the rate of printing. This is advantageous because many measurement systems, such as those using spectrophotometers, may operate at half or less the print speed (e.g., by processing along the length of web 120 at one or more orders of magnitude slower than the print speed). This difference in operating speed may be particularly notable when a great deal of color accuracy (e.g., within one nanometer or one tenth of a nanometer) is desired, such as when color measurements are being made that require more accuracy than a camera or scanner can provide. Second, because this arrangement enables the measurement system 140 to measure a printed job without moving portions of the web 120 at the entrance 142 or the exit 144, the inspection process prevents the web 120 from pulling against internal components of the production printer 110 or other in-line device during inspection. This is highly beneficial because it prevents tearing of the web 120. In short, depending on the embodiment, attempting to draw web 120 through an idle printer may result in tension from internal components of the printer, and such tension could result in tearing of the web 120. By performing inspection operations internally at the measurement system 140, the risk of such incidents is eliminated.

After the printed job has been measured (e.g., fully measured) by measurement system 140, the web 120 is advanced to re-winder 150 for storage. The printed job may then be cut into pages from the web 120, stacked, processed (e.g., bound), and delivered to a customer. In further embodiments, the printed job proceeds to any suitable post-processing device (e.g., a re-winder, cutter, stacker, slitter, binder, secondary printer or combination of devices).

The particular arrangement, number, and configuration of components described herein is illustrative and non-limiting. For example, although measurement system 140 is depicted as a separate component from production printer 110, in further embodiments the measurement system 140 may be integrated into the production printer 110 (e.g., downstream of a marking engine) as desired.

Figure 2:
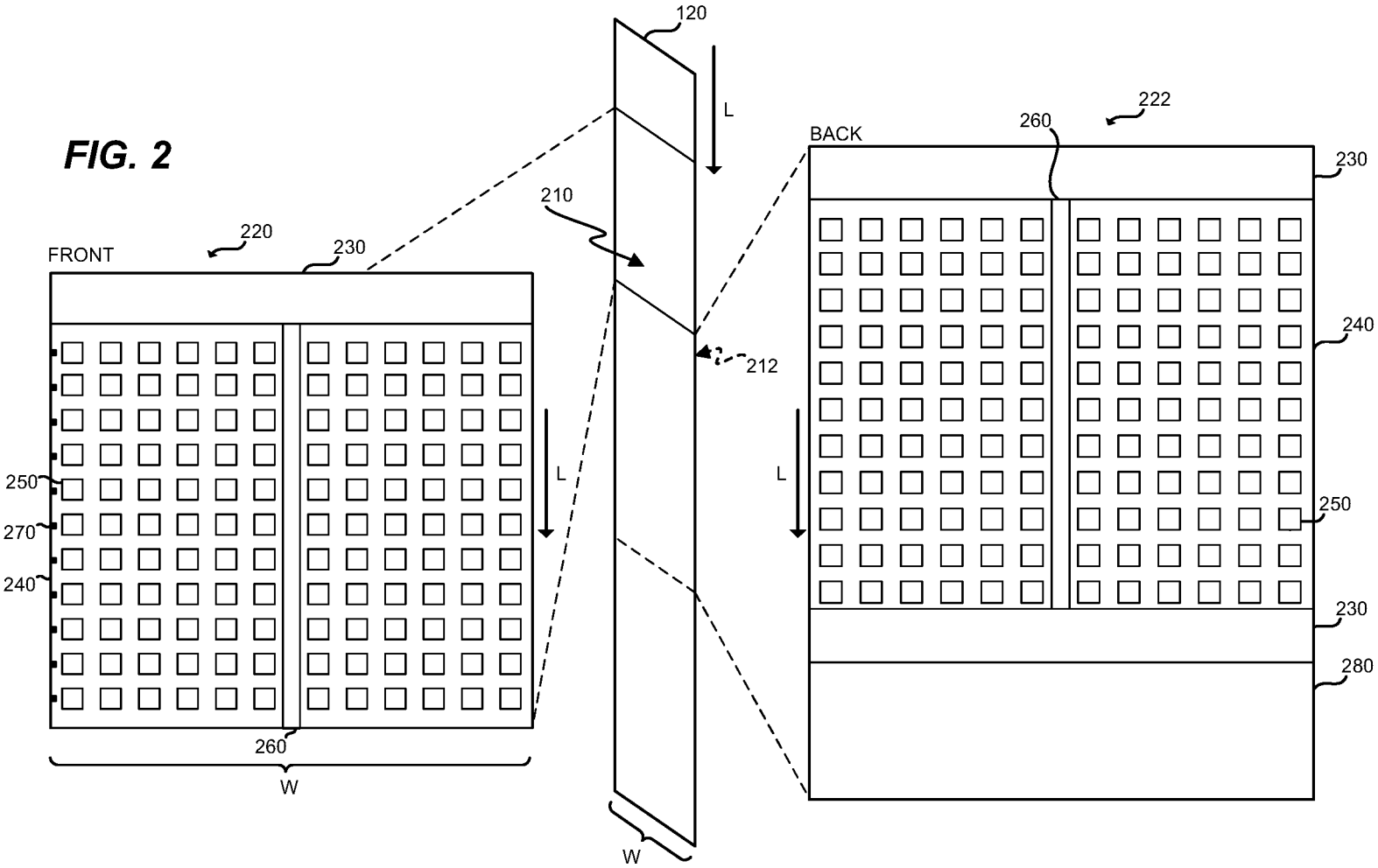
FIG. 2 depicts a web having test patches printed on a front side and a back side in an illustrative embodiment.

FIG. 2 depicts a web 120 that has been marked by the production printer 110 in an illustrative embodiment. In this embodiment, web 120 includes test patches 250 printed on a front side 210 and a back side 212. Test patches 250 comprise predefined regions of the web 120 that are expected to display a specific color, shape, size, or other measurable metric. Test patches 250 may comprise solid patches used to develop International Color Consortium (ICC) Profiles, solid patches used to characterize print-engine print quality, solid patches designed for comparison to Pantone or other databases, unique shapes, or other regions designed for comparing high-speed in-line scanner color measurements (e.g., as made by a high-speed scanner within the production printer 110) to spectrophotometer measurements (e.g., as made by measurement system 140), such as Fogra Media Wedge.

By measuring test patches 250, the measurement system 140 characterizes the quality of the corresponding printed job. The measurements lead to a conclusion regarding the quality of the printed job in neighboring areas to the test patches 250 along a predetermined length (L) and width (W) of the web 120. In this embodiment, the direction of the arrow for L indicates a direction that the web 120 travels during printing. Depending on the determined quality, the printed job may be reprinted. In this embodiment, test patches 250 are contained within a front region 220 and a back region 222 of the web 120. The front region 220 includes a page gap 230, a gutter 260 and a group of test patches 250. In this embodiment, the location of each row of test patches 250 in the front region 220 is indicated with a mark 270 at an edge 240 of the web. These marks 270 advantageously enable a sensor of the measurement system 140 to detect the location of rows of test patches 250. In further embodiments, marks 270 may be placed at any suitable location, including for example the back region 222, The back region 222 also includes page gaps 230, a gutter 260, and test patches 250. The back region 222 further includes a stop tolerance area 280 in this embodiment, although in further embodiments the stop tolerance area 280 may be located at the front region 220. The stop tolerance area 280 is an unmarked region of web 120 having a length corresponding with an expected variation in stop location. For example, when printing halts, the web 120 may be halted within one and a half inches of an expected stop location along its length. Thus, a stop tolerance area 280 may comprise three inches of length, accounting for one and a half inches of deviation either forward or backward from the expected stop location.

Additional items, such as patches used as the data source for ICC color profiles, may be included within the front region 220 and/or back region 222 as desired. In further embodiments, test patches 250 may be included within every page printed onto the web 120 for a printed job. For example, each page may include ten or more rows of test patches 250 for analysis. In such a circumstance, the number of test patches 250 for measurement may be orders of magnitude higher than the number of pages in the printed job.

With an understanding of the underlying arrangement of items for measurement at an illustrative web, the discussion continues with regard to operation of a measurement system 140 that actively scans a web 120 that has been marked with a printed job, such as during a pause between printing of printed jobs by the production printer 110.

Illustrative details of the operation of measurement system 140 will be discussed with regard to FIG. 3. Assume, for this embodiment, that the production printer 110 has initiated printing and is advancing the web 120 through the printing system 100.

FIG. 3 is a flowchart illustrating a method 300 for operating a measurement system 140 at a printing system 100 in an illustrative embodiment. The steps of method 300 are described with reference to measurement system 140 of FIG. 1, but those skilled in the art will appreciate that method 300 may be performed in other systems. The steps of the flowcharts described herein are not all inclusive and may include other steps not shown. The steps described herein may also be performed in an alternative order.

In step 302, the measurement system 140 receives the web 120 of print media 122, which has been marked with a printed job by the production printer 110. For example, portions of the web 120 that advance out of the production printer 110 during printing may proceed via the operation of one or more rollers 130 in the web direction directly into the measurement system 140. Step 302 may occur while printing is in progress and the measurement system 140 is in an idle mode where it operates as a pass-through entity. In an idle mode, the measurement system 140 is configured to permit the web 120 to travel at a rate of speed typical of printing, without causing undue tension in the web 120. Specific aspects of the idle mode will be discussed with regard to FIG. 4 below. However, in one embodiment the controller 146 operates fixed rollers and drive rollers (e.g., locking rollers 410, fixed rollers 412, first roller 420, and second roller 430, of FIG. 4) that contact the web 120 in a passive mode, such that the rollers do not resist motion of the web 120.

In step 304, controller 146 determines that a segment (e.g., segment 402 of FIG. 4) of the web 120 that includes the printed job is stationary at the measurement system 140. This determination may be based on feedback from a sensor (e.g., sensor 460 of FIG. 4), feedback from a roller 130 indicating that the roller 130 has stopped rotating, input from a camera that tracks movement of the web 120, a control signal from the production printer 110 or a print server, or other input.

When the web 120 has stopped, controller 146 may query the production printer 110 for confirmation that printing has concluded, or may assume such. At this point in time, the measurement system 140 moves from an idle mode (i.e., for a printing phase) to an active mode (i.e., for a measuring phase). The active mode encompasses steps 304-310. In the active mode, the measurement system 140 proceeds to iteratively internally advance the web 120, scan a portion the web 120, and further internally advance the web 120 as discussed in steps 304-310.

In step 306, a repositioning mechanism 148 in the measurement system 140 repositions the segment relative to an image measurement device (e.g., an image measurement device 440 of FIG. 5) while the web 120 (i.e., at least portions of the web 120 at the entrance 142 and the exit 144) remain stationary. This operation is discussed in detail with regard to FIGS. 4-6 below, and involves the coordinated motion of a first roller 420 and a second roller 430, depicted in FIGS. 4-6.

Step 308 comprises operating the image measurement device to inspect the segment of the web 120. In embodiments where the image measurement device comprises a spectrophotometer, densitometer, or other device, this may comprise acquiring optical measurements of wavelength, optical density, absorbance, opacity, or other metrics at a fine level of precision. In such embodiments, the measurements acquired are of a higher precision than can be achieved with a high-speed camera, such as precision to within one nanometer or one tenth of a nanometer when measuring wavelength, or a precision of one percent when measuring absorbance, etc.

In step 310, the controller 146 determines whether a desired area (e.g., the entirety) of the printed job has been inspected. This determination may be in response to detecting a mark that indicates the end of a printed job, determining that a predefined number of linear feet have been measured by the image measurement device, reviewing known inspection locations at the printed job, etc. If a desired area of the printed job has not yet been inspected, processing returns to step 306. Alternatively, if the desired area of the printed job has been inspected, processing advances to step 312.

Steps 312-314 represent a further idle mode, wherein the printed job is moved into a location where it can be stored for later cutting, stacking, and/or other processing. Steps 312-314 are therefore optional but are provided for the sake of context.

In step 312, the web 120 is released. This may be accomplished via release of locking rollers (e.g., locking rollers 410 of FIG. 4) at the measurement system 140 that hold the web 120 in place, or via other means. With the web 120 released, the web 120 may be advanced through the measurement system 140 in the web direction.

In step 314, the printed job is stored on the re-winder 150 for further processing. The web 120 may then be removed from re-winder 150 for post-print processing at another location, followed by delivery of the finished documents to a customer.

Method 300 provides a technical benefit over prior systems, because it allows for a measurement system 140 to be placed in-line with a production printer 110, even when the measurement system 140 operates at a much lower linear rate of speed than the production printer. This in turn ensures that out-of-tolerance conditions in a printed job can be rapidly detected, before the printed job leaves the area of the production printer 110. That is, if a printed job includes out-of-tolerance conditions which would require a reprint, that printed job may be immediately reprinted. This enables rapid detection of errors that would require a reprint after a printed job has been printed. This also saves processing time and physical wear at cutters, stackers, sorters, binders, and other post-print processing devices that would otherwise process the printed job before the issue was detected. Still further, because the measurement system 140 is capable of independently measuring the web 120 without changing the position of the web 120 relative to other devices, the measurement system 140 is capable of being used during off-hours while a production printer is not in use. This provides a technical benefit by enabling inspection to be performed at different times than when printing is performed, such as after the ink for a printed job has fully dried, when colors used for the printed job have stabilized.

An additional technical benefit of performing measurements of test patches in-line (as opposed to via conventional methods of measuring sheets that have been cut from a web off-line) is that the web is not disrupted by the measurement process. For example, some conventional methods require the web to be cut into sheets after exiting the printer. The web may then be measured, and spliced together at the cut-out location so that printing may resume. Alternative conventional methods require cut sheets to be retrieved from the output of a cutter. Still further conventional methods are incapable of performing measurement, because the process of binding applies cuts/folds/binding in a location that will block the taking of measurements. The systems and methods described herein preserve the integrity of the web (i.e., avoid any need for cutting the web or splicing the web back together), and also save labor by an operator of a printing system which would otherwise be spent cutting the web, taking the cut sheets over to a measurement device, and splicing the web.

Figure 4:
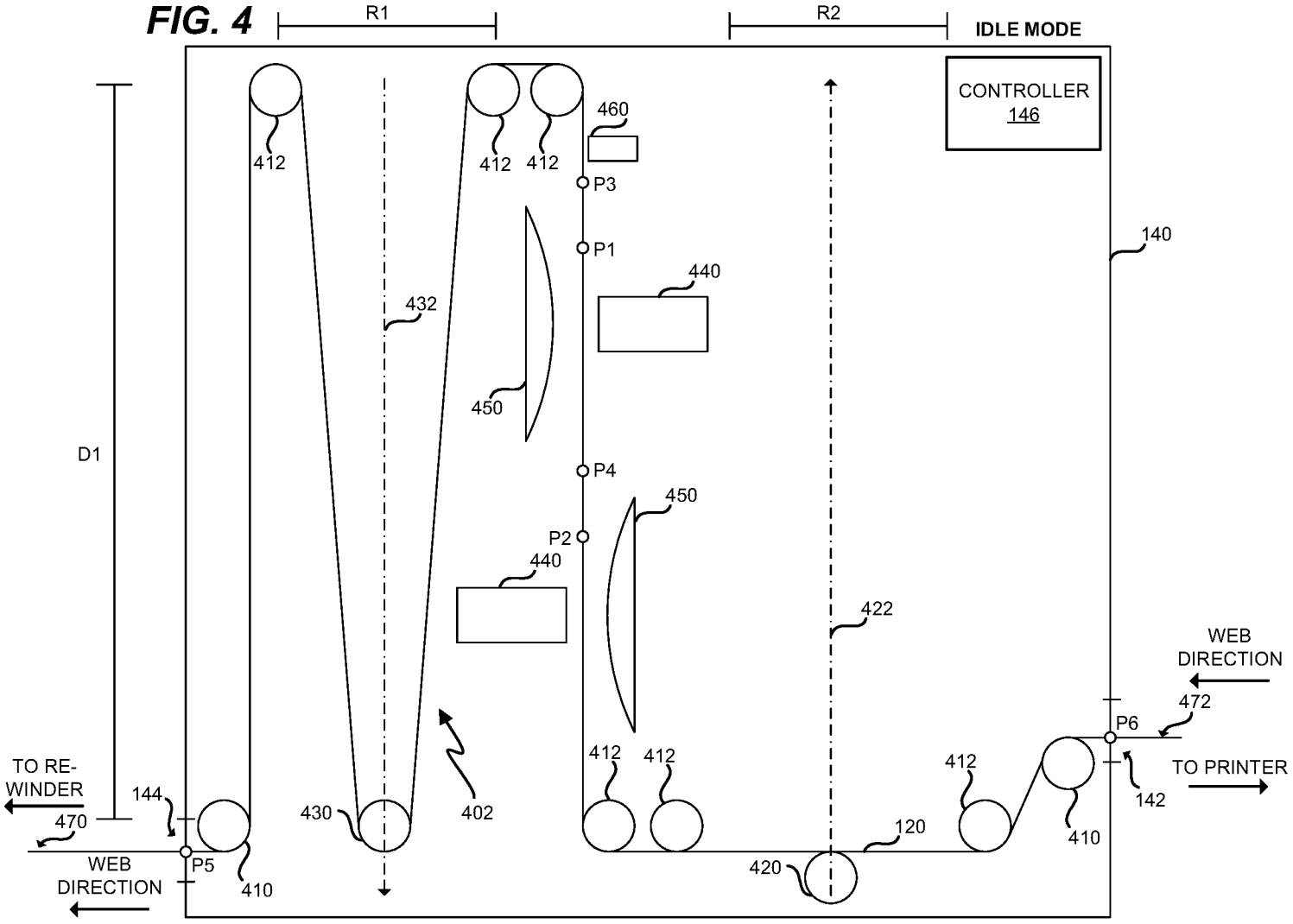
FIGS. 4-6 depict operation of a measurement system that inspects a printed job while a web remains stationary at an entrance and exit of the measurement system, in an illustrative embodiment.
Figure 5:
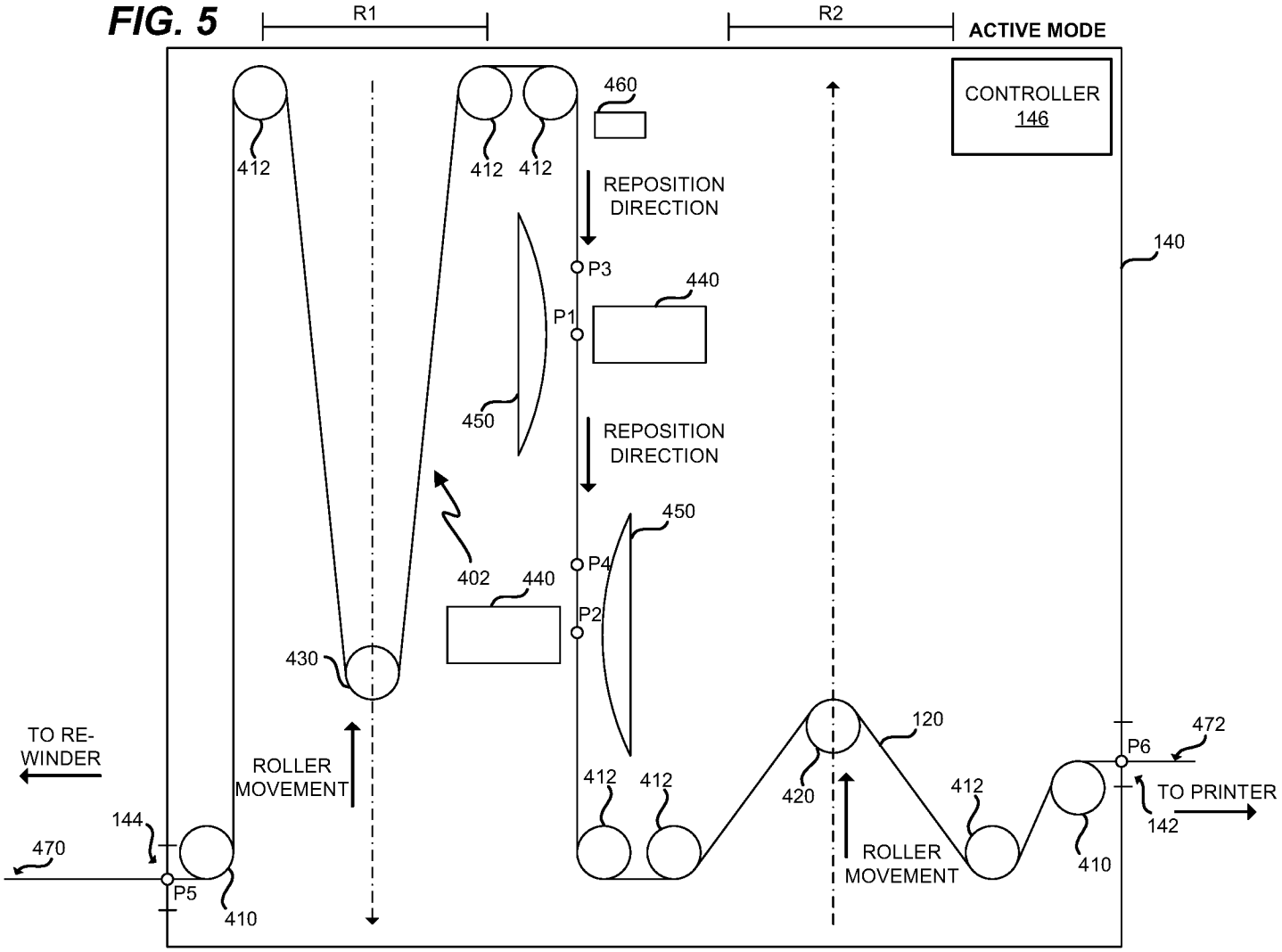
Figure 6:
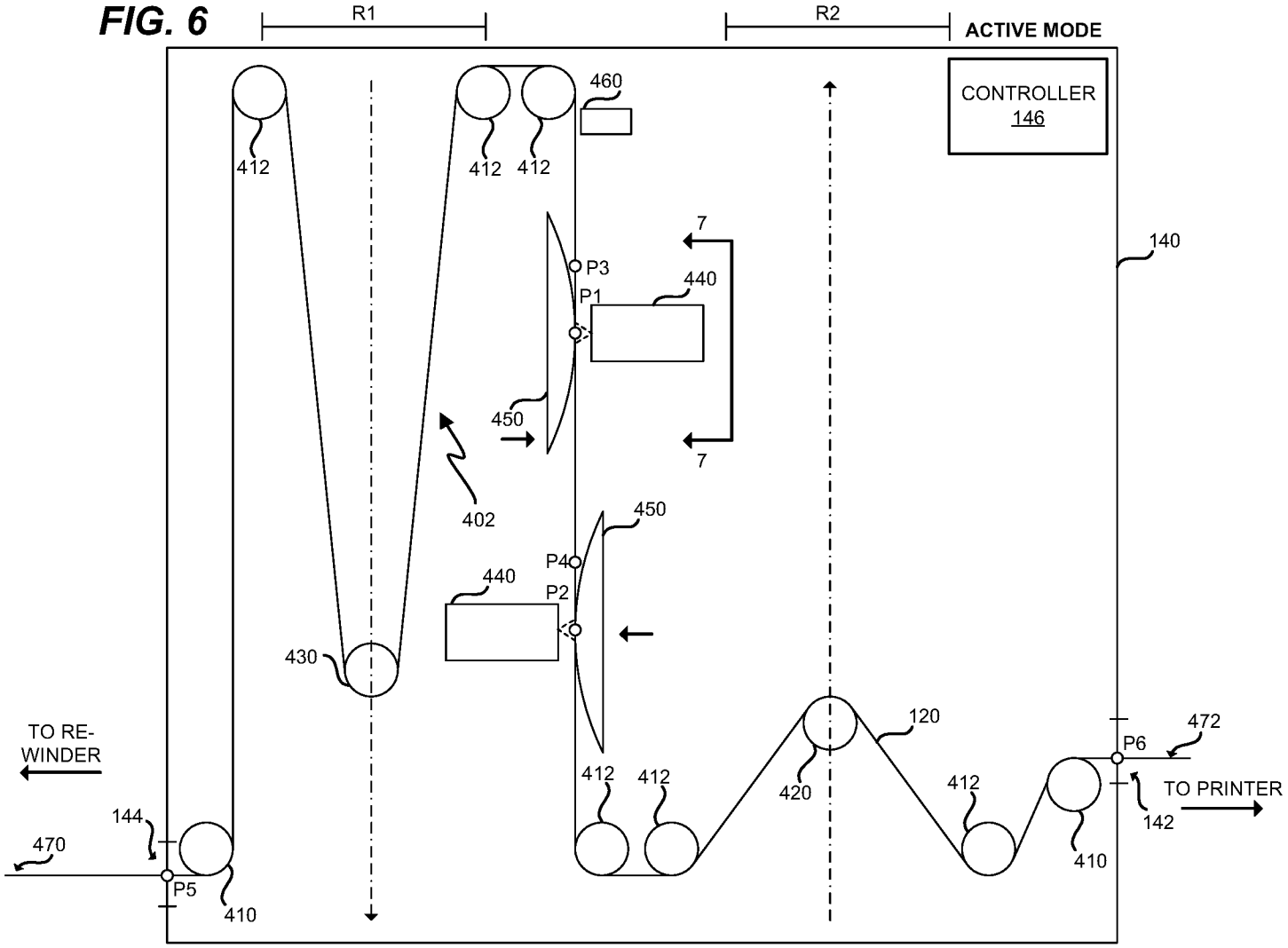

FIGS. 4-6 depict operation of a measurement system 140 that inspects a printed job while a web 120 remains stationary at an entrance 142 and exit 144 in an illustrative embodiment. The measurement system 140 has been enhanced to utilize internal drive rollers which are capable of moving together in coordination during inspection of a segment 402 of the web 120 that includes a printed job. These movements advance the segment 402 of web 120 across an image measurement device 440. As will be explained below, the coordinated motion of the drive rollers enables portions of the web 120 at an entrance 142 and an exit 144 to remain stationary, even as other portions of the web 120 internal to the measurement system 140 are moved.

In this embodiment, measurement system 140 includes multiple rollers 412 (that are configured to receive the web 120 of print media after the web 120 has been marked with a printed job, and are further configured to route the web 120 through the measurement system 140. In this embodiment, the rollers 412 are fixed-position rollers that roll but do not change position.

Measurement system 140 also includes locking rollers 410. Locking rollers 410 are configured to brake the web 120 to prevent motion of the web 120 beyond the bounds of measurement system 140, particularly at entrance 142 and exit 144. In further embodiments, the web 120 at the entrance 142 and the exit 144 may be braked by external devices, such as internal components of the production printer 110. In such embodiments, locking rollers 410 may be omitted from the measurement system 140 or substituted with fixed-position rollers.

After fixed rollers 412 and locking rollers 410 have positioned the web 120 (i.e., after printing), inspection of the web 120 may proceed. To this end, measurement system 140 also includes image measurement devices 440 that are configured to inspect the printed job. For example, image measurement devices 440 may each measure a front side or a back side of the web 120. In one embodiment, image measurement devices 440 comprise spectrophotometers that inspect the printed job by analyzing test patches 250 of the printed job for color accuracy. In further embodiments, image measurement devices 440 comprise densitometers, high-resolution cameras that operate at a slower linear rate than the production printer 110, or other devices. Although two image measurement devices 440 are depicted in this embodiment, in further embodiments more or fewer image measurement devices 440 may be utilized in order to measure the front side, back side, or both sides of the web 120. Furthermore, the image measurement devices 440 are fixed relative to the length of the web in this embodiment, and are capable of motion along a width of the web 120.

Backing plates 450 facilitate the operations of the image measurement devices 440. Specifically, the backing plates 450 are configured to contact the web 120 at the image measurement devices 440 while the segment 402 is stationary. The backing plates 450 each press against the web 120 at an opposite side of the web 120 from a corresponding image measurement device 440. The backing plates 450 provide an opaque backstop that enables characterization of test patches 250 to a known standard. In some embodiments, backing plates 450 may be omitted from the measurement system 140 if an opaque backstop is not needed due to the test patches 250 locations or print media 122 characteristics (i.e., stiffness, thickness, opacity).

In this embodiment, repositioning mechanism 148 comprises drive rollers that are utilized to advance the segment 402 across the image measurement devices 440 while the web 120 is braked. Specifically, the drive rollers are configured to reposition the segment 402 within the measurement system 140 relative to the image measurement devices 440, while the web 120, and/or portions P5 and P6 of the web 120 external to the measurement system 140, such as proximate to the entrance 142 and the exit 144, remain stationary. The drive rollers include a first roller 420 and a second roller 430. The first roller 420 and the second roller 430 are configured to collaboratively translate in order to move segment 402 of the web 120 within the measurement system 140 (e.g., incrementally across a distance up to D1), and are held in idle positions by the controller 146 when the measurement system 140 is in an idle mode, as shown in FIG. 4. In an active mode, the first roller 420 and the second roller 430 translate while in contact with the web 120 as shown in FIG. 5.

The first roller 420 is driven into motion by an internal actuator that controllably maintains a position along axis 422 in response to input from the controller 146. The internal actuator may comprise a stepper motor or other drive. Translation of the second roller 430 is controlled by an actuator, spring, or other component that causes the second roller 430 to maintain a constant tension on the web by moving along axis 432. In one embodiment, the first roller 420 and the second roller 430 are implemented with a reciprocating servo using a stepper motor and belt drive.

When the first roller 420 is moved, the second roller 430 also moves in order to maintain a constant web tension. In this manner, translation of the first roller 420 enforces a corresponding translation of the second roller 430 to maintain tension at the segment 402. That is, translation of the second roller 430 is caused in response to translation of the first roller 420. Coordinated motion of the first roller 420 and the second roller 430 causes the segment 402 to move between the first roller 420 and the second roller 430 (as shown in FIGS. 5-6). In this embodiment, the image measurement device 440 is disposed between the first roller 420 and the second roller 430. Thus, motion of the segment 402 between the first roller 420 and the second roller 430 repositions the segment 402 relative to the image measurement device 440.

Measurement system 140 further includes a sensor 460 in this embodiment. Measurements from the sensor 460 are used by controller 146 to ensure that the drive rollers incrementally advance the web 120 by desired amounts. In this embodiment, sensor 460 comprises a visual sensor that is configured to detect marks 270 at an edge 240 of the web 120. Each mark 270 indicates the presence of one or more test patches 250 in a row at the printed job. Thus, when sensor 460 detects a mark 270, controller 146 may instruct the first roller 420 to halt. In further embodiments, sensor 460 comprises a device such as a rotary sensor that determines an amount of linear distance that the web 120 has moved. Regardless of the implementation of sensor 460, input from sensor 460 may be utilized by controller 146 to control motion of the web 120 within the measurement system 140.

As shown in FIG. 4, web 120 has just finished being marked by production printer 110. Segment 402, which is contained within the measurement system 140, has been marked with a printed job. In this embodiment, the segment 402 has advanced past the image measurement devices 440 in the measurement system 140, even though this has advanced portions P1, P2, P3, and P4 for measurement past the image measurement devices 440. Placement of the segment 402 within the measurement system 140 may be managed by the controller 146 via action of the production printer 110, rollers 130 that are actively driven, or via other means. In one embodiment, a paper runout length is adjusted or controlled by the production printer 110 in order to enhance location accuracy of the segment 402 within the measurement system 140. Controller 146 is configured to determine that the segment 402 is stationary within the measurement system 140, based on input from sensor 460, from the production printer 110, or other input.

Although the segment 402 is within (e.g., entirely within) the measurement system 140, the measurement system 140 remains in an idle mode. In the idle mode, the measurement system 140 passively routes incoming portions of web 120 without increasing resistance or tension at the web 120. In this embodiment, this means that the first roller 420 may be retracted to a position where it does not displace or apply tension to the web 120. This enables the web 120 to travel into the measurement system 140 at full printing speed without risking a tear. In the idle state, image measurement devices 440 and backing plates 450 may be retracted from the web 120. Additionally, locking rollers 410 remain in an unlocked state, and hence freely roll as the web 120 continues in the web direction.

To initiate the process of measuring the segment 402, controller 146 locks the locking rollers 410 in order to brake the web 120, causing the web 120 to remain stationary at portions P5 (disposed at a downstream area 470 of the web 120) and P6 (disposed at an upstream area 472 of the web 120). In further embodiments, the web 120 may be braked by other means.

With portions P5 and P6 stationary and locked in position by the locking rollers 410, the controller 146 initiates an active mode wherein the segment 402 is measured at multiple positions along the length of the web 120. During measurement, the segment 402 may be iteratively and incrementally moved in a direction opposed to the web direction that existed during printing, which causes portions P1-P4 to be drawn backwards (i.e., relative to a direction of motion of the web 120 during printing) and placed for inspection at image measurement devices 440. In further embodiments, swapping the position of the first roller 420 and the second roller 430 enables the segment to be drawn forward (i.e., in the same direction as used for printing) during inspection. By iteratively moving and inspecting the segment 402, test patches 250 within the segment may be characterized and/or measured as desired. Furthermore, because portions P5 and P6 remain stationary, movement of the segment 402 does not increase tension at upstream or downstream devices, which results in a technical benefit by reducing or eliminating the risk of the web 120 tearing or breaking during inspection.

In FIG. 5, the segment 402 is moved internally while portions P5 and P6 remain stationary. This innovative operation is performed by translating the first roller 420 as depicted in FIG. 5, via the operation of an actuator internal to the first roller 420, or any other suitable drive component. The act of translating/moving the first roller 420 applies tension along the segment 402. The increased tension reaches the second roller 430, which is designed to displace in order to maintain a constant level of tension at the segment 402. In response to the translation of the first roller 420 causing increased tension, second roller 430 translates, in this case in the same direction as the first roller 420. Functionally, this results in the first roller 420 creating tension that pulls the segment 402 towards it, while second roller 430 reduces tension, enabling the segment 402 to travel away from it. Stated in another way, segment 402 is released from region R1 and taken up in region R2. By coordinating these motions, controller 146 is capable of programmatically advancing portions P1 and P2 in a reposition direction towards the image measurement devices 440 for analysis. This takes place even though portions P5 and P6 remain stationary.

In FIG. 6, portions P1 and P2 have arrived at image measurement devices 440 for inspection, and movement of the segment 402 is halted. After the segment 402 is halted, backing plates 450 contact the segment 402, providing an opaque backing for the web 120 while the segment 402 is stationary. Image measurement devices 440 then proceed to measure the test patches 250, or other relevant portions of the segment 402.

Figure 7:
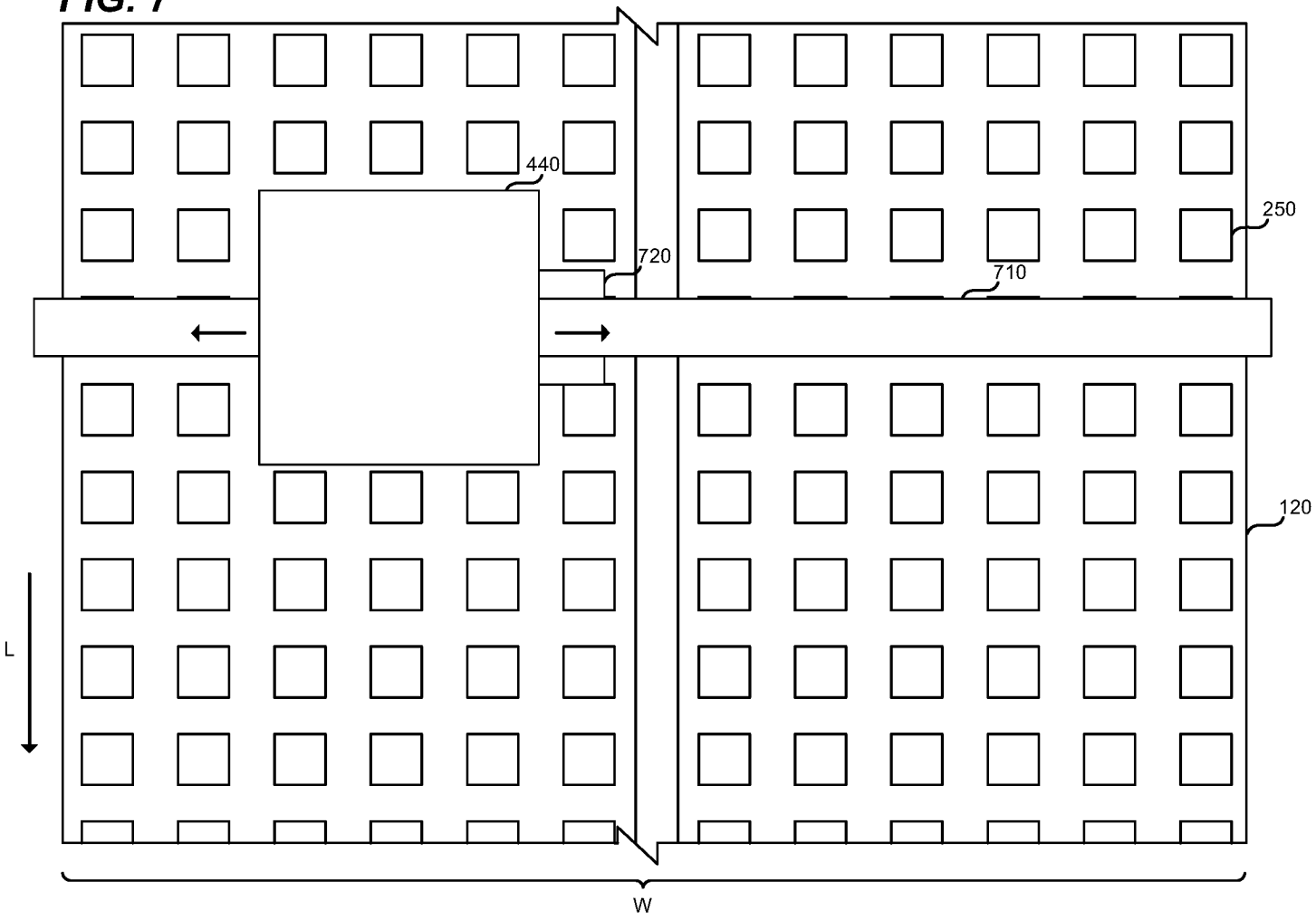
FIG. 7 depicts an image measurement device that travels along a width of a web to inspect the web in an illustrative embodiment.

FIG. 7 depicts an image measurement device 440 that travels along a width of a web 120 to inspect the web 120 in an illustrative embodiment, and corresponds with view arrows 7 of FIG. 6. As shown in FIG. 7, image measurement device 440 is movably coupled with a rail 710, and advances at the rail along a width of the web 120 via operation of an actuator 720 (e.g., a linear actuator, stepper motor, or other drive system). Controller 146 may operate the image measurement device 440 and/or actuator 720 in order to review the test patches 250 which are distributed across the width of the web 120. Thus, during each pause of the web 120 while the backing plates 450 are engaged, controller may iteratively operate the image measurement device 440 to inspect a test patch 250, operate the actuator 720 to advance the image measurement device 440 along the width of the web 120, inspect a next one of the test patches 250, and so on until all test patches 250 until a row of test patches 250 have been inspected.

Upon completion of inspection of test patches 250 in the row, backing plate 450 is retracted and image measurement device 440 awaits receipt of a next row of test patches 250. In one embodiment, in order to reduce wear and/or delay, image measurement device 440 is iteratively operated to measure the test patches 250 from left to right for one row, and then from right to left for the next row. This provides a technical benefit by eliminating the need for returning the image measurement device 440 to a default position along the width of the web 120 after each row is measured.

While FIG. 7 depicts an embodiment wherein an image measurement device 440 is scanned/swept across the width of the web 120, in further embodiments the image measurement device 440 may be held stationary. For example, the image measurement device 440 may be capable of measuring across the width of the web 120 at once, or may only need to measure a specific widthwise portion of the web 120. This provides a technical benefit by reducing the expense of fabricating the measurement system 140.

Figure 8:
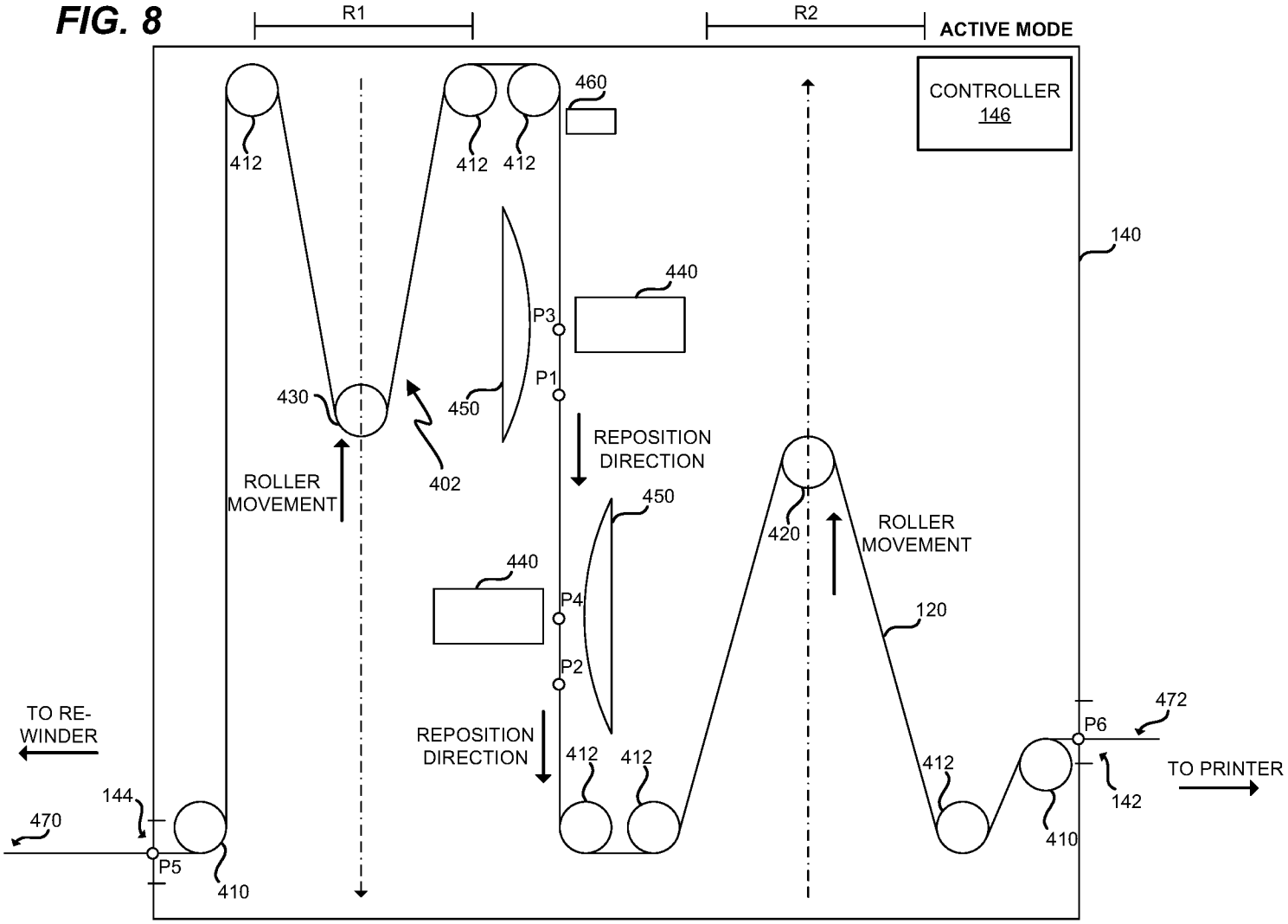
FIG. 8 depicts further operation of a measurement system that inspects a printed job while a web remains stationary at an entrance and exit of the measurement system, in an illustrative embodiment.

FIG. 8 depicts further operation of a measurement system 140 that inspects a printed job while a web 120 remains stationary at an entrance 142 and an exit 144 of the measurement system, in an illustrative embodiment. Specifically, in FIG. 8, the backing plates 450 have been retracted, while the coordinated motions of the first roller 420 and the second roller 430 incrementally move the segment 402 further in the reposition direction to expose portions P3 and P4 for inspection by the image measurement devices 440. The backing plates 450 then re-engage, another row of test patches is inspected, and then the first roller 420 and second roller 430 move in tandem once more to expose a next row of test patches, and so on until a desired area of the printed job has been inspected. Thus, for a one-hundred page printed job, first roller 420 and second roller 430 may reposition the segment 402 a thousand times or more to enable inspection of numerous ones of the test patches 250, or other portions of a printed job.

Input received from image measurement devices 440 is stored in a memory of controller 146. In one embodiment, this input comprises spectrophotometric information (e.g., highly accurate wavelength information from a spectrophotometer having nanometer precision), densitometry information (e.g., highly accurate optical color density information from a densitometer), image data for character recognition (e.g., high resolution images of characters printed onto the page from a high-resolution camera), or other information. This stored input is correlated with each test patch by controller 146, which then compares the input to expected measurements for each test patch. If the amount of deviation for a test patch 250 exceeds a threshold defined in memory, the controller 146 takes action to resolve the issue. For example, controller 146 may transmit an electronic message to a technician to inspect the test patch 250 manually, may flag the printed job (or a portion thereof) for reprinting, direct the production printer 110 to reprint the printed job, or perform other actions as desired. Illustrative examples of deviation may comprise deviation from an expected wavelength of light as measured by a spectrophotometer, differences between measured absorbance or transmittance levels for light measured by a densitometer, and others.

Examples

In the following examples, additional processes, systems, and methods are described in the context of a measurement system for a continuous-forms production printer.

The following clauses and/or examples pertain to further embodiments or examples. Specifics in the examples may be used anywhere in one or more embodiments. The various features of the different embodiments or examples may be variously combined with some features included and others excluded to suit a variety of different applications. Examples may include subject matter such as a method, means for performing acts of the method, at least one machine-readable medium including instructions that, when performed by a machine cause the machine to perform acts of the method, or of an apparatus or system according to embodiments and examples described herein.

A first example includes a measurement system comprising rollers configured to receive a web of print media marked with a printed job, a controller configured to determine that a segment of the web is stationary at the measurement system, an image measurement device configured to inspect the printed job, and a repositioning mechanism configured to reposition the segment within the measurement system relative to the image measurement device while portions of the web external to the measurement system remain stationary.

A second example includes the measurement system of the first example wherein: the repositioning mechanism is configured to reposition the web in a direction opposed to a direction of travel of the web during printing.

A third example includes the measurement system of the first example wherein: the repositioning mechanism comprises: a first roller; and a second roller, wherein the segment of the web is disposed between the first roller and the second roller; wherein the first roller is configured to translate to apply tension to the web; wherein the second roller is configured to translate in response to translation of the first roller to reduce tension on the web; and wherein the controller is configured to direct operations of the first roller and the second roller to reposition the segment.

A fourth example includes the measurement system of the third example wherein: in response to the first roller translating in a direction, the second roller translates in the same direction.

A fifth example includes the measurement system of the third example wherein: the image measurement device is disposed between the first roller and the second roller.

A sixth example includes the measurement system of the first example further comprising: locking rollers configured to brake the web to prevent motion of the web at an entrance and an exit of the measurement system, in response to instructions from the controller.

A seventh example includes the measurement system of the first example wherein: a backing plate disposed on an opposite side of the web in relation to the image measurement device, wherein the controller is configured to move the backing plate into contact with the opposite side of the web while the segment is stationary.

An eight example includes the measurement system of the first example wherein: the image measurement device comprises a spectrophotometer configured to analyze test patches on the web, wherein the controller is configured to activate the image measurement device during pauses between operation of the repositioning mechanism.

A ninth example includes the measurement system of the first example further comprising: a sensor configured to detect marks at an edge of the web indicating a presence of test patches on the web, wherein the controller is configured to direct operation of the repositioning mechanism based on feedback from the sensor.

A tenth example includes a printing system comprising: a printer; and the measurement system of the first example, configured to receive a printed job from the printer that has been marked onto a web of continuous-forms print media.

An eleventh example includes a method comprising: receiving a web of print media marked with a printed job at a measurement system; determining that a segment of the web that includes the printed job is stationary at the measurement system; and iteratively: repositioning the segment within the measurement system relative to an image measurement device while portions of the web external to the measurement system remain stationary; and operating the image measurement device to inspect the printed job.

A twelfth example includes the eleventh example wherein: while the segment is stationary at the measurement system, the segment is disposed between a first roller and a second roller, and repositioning the segment comprises translating the first roller to apply tension to the web, and translating the second roller in response to translation of the first roller, to reduce tension on the web.

A thirteenth example includes the twelfth example wherein: in response to the first roller translating in a direction, the second roller translates in the same direction.

A fourteenth example includes the twelfth example wherein: repositioning the segment is performed between the first roller and the second roller.

A fifteenth example includes the eleventh example further comprising: operating locking rollers to brake the web to prevent motion of the web at an entrance and an exit of the measurement system.

A sixteenth example includes the eleventh example wherein: the image measurement device comprises a spectrophotometer, and operating the image measurement device to inspect the printed job comprises analyzing test patches of the printed job for color accuracy.

A seventeenth example includes a non-transitory computer readable medium embodying programmed instructions which, when executed by a processor, are operable for performing a method comprising: receiving a web of print media marked with a printed job at a measurement system; determining that a segment of the web that includes the printed job is stationary at the measurement system; and iteratively: repositioning the segment within the measurement system relative to an image measurement device while portions of the web external to the measurement system remain stationary; and operating the image measurement device to inspect the printed job.

An eighteenth example includes the seventeenth example wherein while the segment is stationary at the measurement system, the segment is disposed between a first roller and a second roller, and repositioning the segment comprises translating the first roller to apply tension to the web, and translating the second roller in response to translation of the first roller, to reduce tension on the web.

A nineteenth example includes the eighteenth example wherein: in response to the first roller translating in a direction, the second roller translates in the same direction.

A twentieth example includes the seventeenth example wherein: the image measurement device comprises a spectrophotometer, and operating the image measurement device to inspect the printed job comprises analyzing test patches of the printed job for color accuracy.

Figure 9:
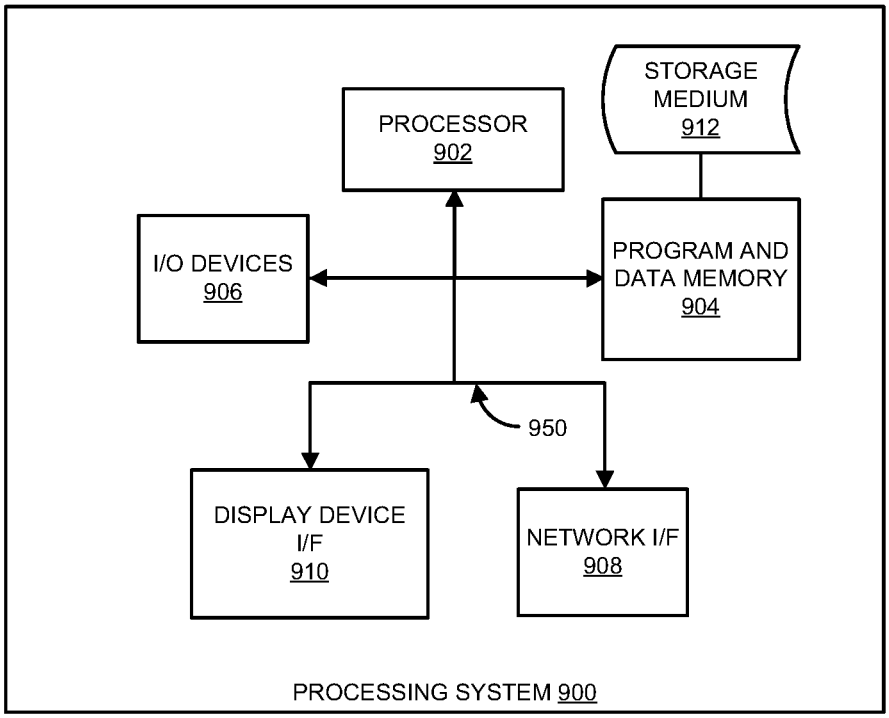
FIG. 9 illustrates a processing system operable to execute a computer readable medium embodying programmed instructions to perform desired functions in an illustrative embodiment.

Embodiments disclosed herein can take the form of software, hardware, firmware, or various combinations thereof. In one particular embodiment, software is used to direct a processing system of measurement system 140 to perform the various operations disclosed herein. FIG. 9 illustrates a processing system 900 operable to execute a computer readable medium embodying programmed instructions to perform desired functions in an illustrative embodiment. Processing system 900 is operable to perform the above operations by executing programmed instructions tangibly embodied on computer readable storage medium 912. In this regard, embodiments of the invention can take the form of a computer program accessible via computer-readable medium 912 providing program code for use by a computer or any other instruction execution system. For the purposes of this description, computer readable storage medium 912 can be anything that can contain or store the program for use by the computer.

Computer readable storage medium 912 can be an electronic, magnetic, optical, electromagnetic, infrared, or semiconductor device. Examples of computer readable storage medium 912 include a solid state memory, a magnetic tape, a removable computer diskette, a random access memory (RAM), a read-only memory (ROM), a rigid magnetic disk, and an optical disk. Current examples of optical disks include compact disk-read only memory (CD-ROM), compact disk-read/write (CD-R/W), and DVD.

Processing system 900, being suitable for storing and/or executing the program code, includes at least one processor 902 coupled to program and data memory 904 through a system bus 950. Program and data memory 904 can include local memory employed during actual execution of the program code, bulk storage, and cache memories that provide temporary storage of at least some program code and/or data in order to reduce the number of times the code and/or data are retrieved from bulk storage during execution.

Input/output or I/O devices 906 (including but not limited to keyboards, displays, pointing devices, etc.) can be coupled either directly or through intervening I/O controllers. Network adapter interfaces 908 may also be integrated with the system to enable processing system 900 to become coupled to other data processing systems or storage devices through intervening private or public networks. Modems, cable modems, IBM Channel attachments, SCSI, Fibre Channel, and Ethernet cards are just a few of the currently available types of network or host interface adapters. Display device interface 910 may be integrated with the system to interface to one or more display devices, such as printing systems and screens for presentation of data generated by processor 902.

Although specific embodiments were described herein, the scope of the invention is not limited to those specific embodiments. The scope of the invention is defined by the following claims and any equivalents thereof.

What is claimed is:

1. A measurement system comprising:

rollers configured to receive a web of print media marked with a printed job by a continuous form printer external to the measurement system;

a controller configured to determine that a segment of the web is stationary at the measurement system;

an image measurement device configured to inspect the printed job; and a repositioning mechanism configured to reposition the segment within the measurement system relative to the image measurement device while portions of the web external to the measurement system remain stationary, wherein the rollers comprise locking rollers configured to brake the web to prevent motion of the web at an entrance and an exit of the measurement system, in response to instructions from the controller, and wherein the repositioning mechanism comprises a plurality of rollers configured to translate within the measurement system to reposition the segment relative to the image measurement device while portions of the web external to the measurement system remain stationary.

2. The measurement system of claim 1 wherein:

the repositioning mechanism is configured to reposition the segment in a direction opposed to a direction of travel of the web during printing.

3. The measurement system of claim 1 wherein:

the repositioning mechanism comprises:

a first roller; and a second roller, wherein the segment of the web is disposed between the first roller and the second roller;

wherein the first roller is configured to translate to apply tension to the web;

wherein the second roller is configured to translate in response to translation of the first roller to reduce tension on the web; and wherein the controller is configured to direct operations of the first roller and the second roller to reposition the segment.

4. The measurement system of claim 3 wherein:

in response to the first roller translating in a direction, the second roller translates in the same direction.

5. The measurement system of claim 3 wherein:

the image measurement device is disposed between the first roller and the second roller.

6. The measurement system of claim 1 further comprising:

a backing plate disposed on an opposite side of the web in relation to the image measurement device, wherein the controller is configured to move the backing plate into contact with the opposite side of the web while the segment is stationary.

7. The measurement system of claim 1 wherein:

the image measurement device comprises a spectrophotometer configured to analyze test patches on the web, wherein the controller is configured to activate the image measurement device during pauses between operation of the repositioning mechanism.

8. The measurement system of claim 1 further comprising:

a sensor configured to detect marks at an edge of the web indicating a presence of test patches on the web, wherein the controller is configured to direct operation of the repositioning mechanism based on feedback from the sensor.

9. A printing system comprising:

a printer; and the measurement system of claim 1, configured to receive a printed job from the printer that has been marked onto a web of continuous-forms print media.

10. A method comprising:

receiving a web of print media marked with a printed job at a measurement system, wherein the web is received from a continuous form printer external to the measurement system;

determining that a segment of the web that includes the printed job is stationary at the measurement system;

operating locking rollers to brake the web to prevent motion of the web at an entrance and an exit of the measurement system; and iteratively:

repositioning the segment within the measurement system relative to an image measurement device while portions of the web external to the measurement system remain stationary; and operating the image measurement device to inspect the printed job, wherein repositioning comprises operating a plurality of rollers configured to translate within the measurement system to reposition the segment relative to the image measurement device while portions of the web external to the measurement system remain stationary.

11. The method of claim 10 wherein:

while the segment is stationary at the measurement system, the segment is disposed between a first roller and a second roller, and repositioning the segment comprises translating the first roller to apply tension to the web, and translating the second roller in response to translation of the first roller, to reduce tension on the web.

12. The method of claim 11 wherein:

in response to the first roller translating in a direction, the second roller translates in the same direction.

13. The method of claim 11 wherein:

repositioning the segment is performed between the first roller and the second roller.

14. The method of claim 10 wherein:

the image measurement device comprises a spectrophotometer, and operating the image measurement device to inspect the printed job comprises analyzing test patches of the printed job for color accuracy.

15. A non-transitory computer readable medium embodying programmed instructions which, when executed by a processor, are operable for performing a method comprising:

receiving a web of print media marked with a printed job at a measurement system, wherein the web is received from a continuous form printer external to the measurement system;

determining that a segment of the web that includes the printed job is stationary at the measurement system;

operating locking rollers to brake the web to prevent motion of the web at an entrance and an exit of the measurement system; and iteratively:

repositioning the segment within the measurement system relative to an image measurement device while portions of the web external to the measurement system remain stationary; and operating the image measurement device to inspect the printed job, wherein repositioning comprises operating a plurality of rollers configured to translate within the measurement system to reposition the segment relative to the image measurement device while portions of the web external to the measurement system remain stationary.

16. The medium of claim 15 wherein:

while the segment is stationary at the measurement system, the segment is disposed between a first roller and a second roller, and repositioning the segment comprises translating the first roller to apply tension to the web, and translating the second roller in response to translation of the first roller, to reduce tension on the web.

17. The medium of claim 16 wherein:

in response to the first roller translating in a direction, the second roller translates in the same direction.

18. The medium of claim 15 wherein:

the image measurement device comprises a spectrophotometer, and operating the image measurement device to inspect the printed job comprises analyzing test patches of the printed job for color accuracy.

19. The method of claim 10 further comprising:

repositioning the segment in a direction opposed to a direction of travel of the web during printing.

20. The medium of claim 15 wherein the method step of repositioning the segment further comprises:

repositioning the segment in a direction opposed to a direction of travel of the web during printing.

21. The measurement system of claim 1 wherein:

the repositioning mechanism is further configured to iteratively reposition the segment until a desired area of the printed job has been inspected by the image measurement device.

22. The method of claim 10 wherein:

the method step of iteratively repositioning the segment and operating the image measurement device comprises iterating until a desired area of the printed job has been inspected by the image measurement device.

23. The method of claim 15 wherein:

the method step of iteratively repositioning the segment and operating the image measurement device comprises iterating until a desired area of the printed job has been inspected by the image measurement device.

* * * * *